US006516647B1

(12) United States Patent
Hirschvogel et al.

(10) Patent No.: US 6,516,647 B1
(45) Date of Patent: Feb. 11, 2003

(54) METHOD OF PRODUCING HOMOKINETIC JOINTS

(75) Inventors: Manfred Hirschvogel, Fuchstal/Leeder (DE); Karl Schuster, Westendorf (DE); Peter Kettner, Denklingen (DE); Walter Pischel, Kaufering (DE); Michael Dahme, Kaufering (DE); Hubert Nägele, Fuchstal/Asch (DE)

(73) Assignee: Hirschvogel Umformtechnik, Denklingen (DE)

( * ) Notice: Subject to any disclaimer, the term of this patent is extended or adjusted under 35 U.S.C. 154(b) by 0 days.

(21) Appl. No.: 09/958,390

(22) PCT Filed: Feb. 21, 2000

(86) PCT No.: PCT/EP00/01399

§ 371 (c)(1),
(2), (4) Date: Jan. 22, 2002

(87) PCT Pub. No.: WO00/61317

PCT Pub. Date: Oct. 19, 2000

(30) Foreign Application Priority Data

Apr. 8, 1999 (DE) ..... 199 15 879

(51) Int. Cl.[7] ..... B21B 1/00; B21B 11/00; B21B 3/00

(52) U.S. Cl. ..... 72/67; 72/115; 72/117; 72/356; 29/898.066

(58) Field of Search ..... 72/67, 68, 75, 72/112, 115, 117, 126, 352, 356, 358, 359; 29/898.066

(56) References Cited

U.S. PATENT DOCUMENTS 4,559,803 A * 12/1985 Langford et al. ..... 72/358
6,055,838 A * 5/2000 Ohama et al. ..... 72/356
6,438,844 B2 * 8/2002 Nolden ..... 29/898.066

FOREIGN PATENT DOCUMENTS

DE 196 37 839 10/1997 ..... B21K/1/46
JP 56-111534 * 9/1981 ..... 72/75

OTHER PUBLICATIONS

English translation of the International Preliminary Examination Report for Application No. PCT/EP00/01399, filed Feb. 21, 2000.

* cited by examiner

*Primary Examiner*—Ed Tolan
(74) *Attorney, Agent, or Firm*—Marshall, Gerstein & Borun

(57) ABSTRACT

The invention relates to a method of manufacturing the outer part of a constant velocity joint, the outer part having in the finished condition a hollow chamber with a cylinder-shaped inner wall, in which there are provided ball raceways (1*c*) which run obliquely of the cylinder axis and are inclined with respect to one another. First, a wobble press die (4) is axially introduced into a goblet-shaped preliminary workpiece (1*a*) for the outer part having a conically developing inner and outer wall and pre-formed ball raceways (1*c*) in the inner wall. The preliminary workpiece (1*a*) is pressed (drawing process) by means of the wobble press die (4), sitting on the floor of the hollow chamber, through an opening in an outer die (2), so that a drawing process is carried out in which the preliminary workpiece (1*a*) is so cold formed that the inner wall of the hollow chamber is given a cylindrical shape. Thereafter the outer die (2) and the wobble press die (4), having a truncated cone-shaped outer contour, and having elevations (4*a*) on its outer side corresponding to the ball raceways (1*c*) and having a lesser diameter than the cylindrical hollow chamber of the drawn preliminary workpiece (1*a*), are set into a wobbling circular movement relative to one another such that the elevations (4*a*) of the wobble press die (4) move over the pre-formed ball raceways (1*c*) on the inner wall of the hollow chamber in a pressing and material shaping manner. Thereafter the wobble press die (4) is axially drawn out of the preliminary workpiece (1*a*) and finally, the finished joint outer part is ejected from the outer die (2).

6 Claims, 3 Drawing Sheets

METHOD OF PRODUCING HOMOKINETIC JOINTS

Figure 1:
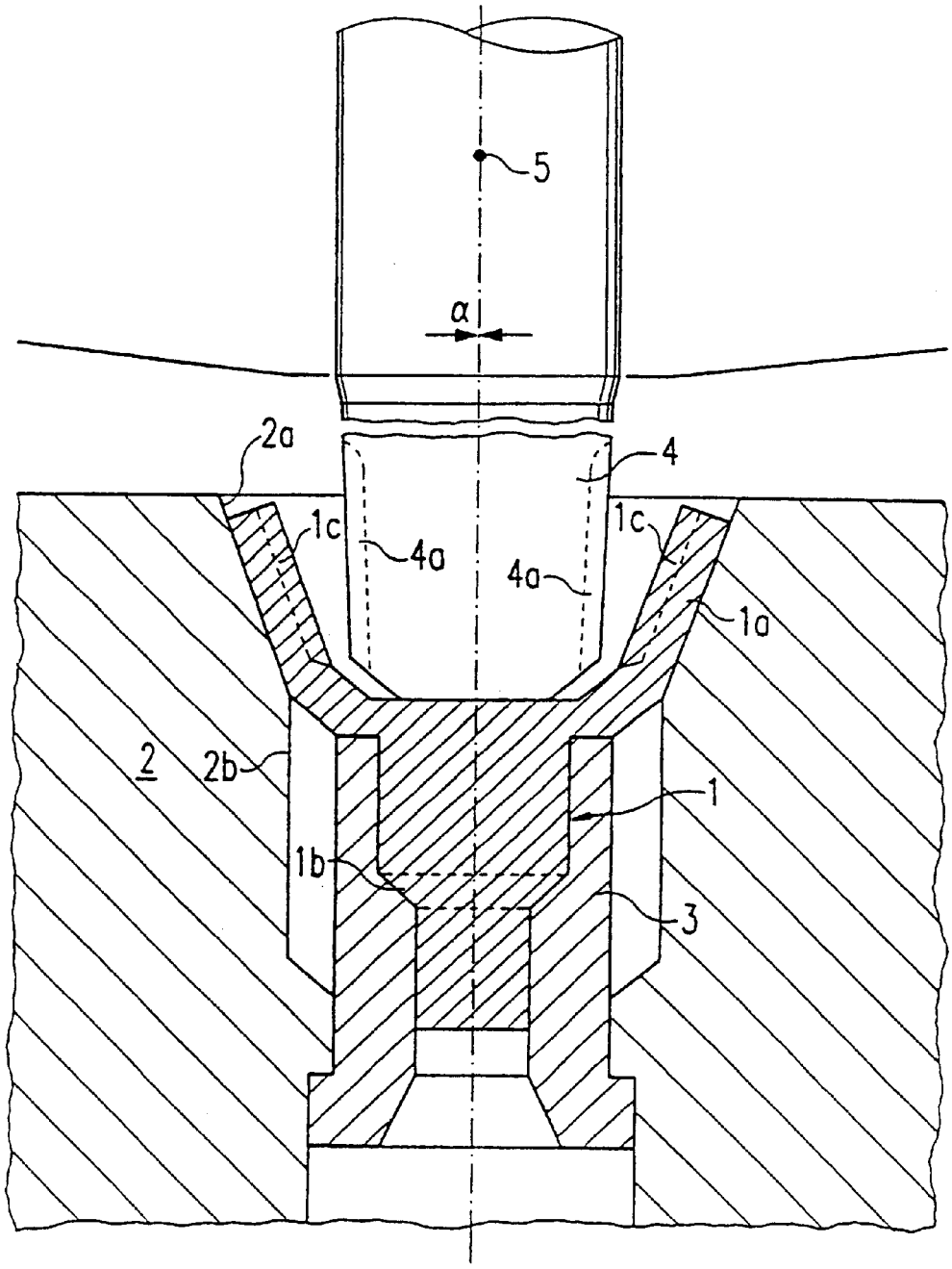

This application is a 35 USC 371 of PCT/EP00/01399 filed Feb. 21, 2000.

The present invention relates to a method of manufacturing outer parts of cross groove constant velocity joints.

With constant velocity joints of this kind, which are described for example in the publication "Universal Joint and Driveshaft Design Manual, Advances in Engineering Series No. 7" of the Society of Automotive Engineers, Inc., the outer part has a cylinder-like internal contour, elongate recesses being made in this. They form ball raceways for the balls arranged in a cage of the inner part. The cylinder-like internal contour of the joint outer part naturally has no undercut. Nevertheless, a separation of outer part and inner part of the constant velocity joint is not immediately possible, since the ball raceways are not axis parallel and furthermore run inclined to one another.

A method of manufacturing joint outer parts of the kind just described is disclosed in patent EP 0 270 538. There, a preliminary workpiece has the shape of a goblet diverging towards the open end, the ball raceways already being pre-formed in its inner side. By means of extrusion drawing of the preliminary workpiece into a cylinder-like opening of an outer die, the preliminary workpiece is so shaped that it finally has a cylinder-shaped internal contour. The necessary force is thereby exercised via an extrusion die which is formed of a plurality of segments movable with respect to one another. These have elevations inclined with respect to one another. There is axially introduced into a hollow chamber located in the extrusion die, before the extrusion of the preliminary workpiece, a spreader which holds the segments in their operative disposition. Upon drawing and shaping of the preliminary workpiece, the elevations of the segments exercise pressure on the inner side of the preliminary workpiece and act in a cold forming manner on the ball raceways inclined with respect to one another.

For removing the extrusion die from the thus worked joint outer part the spreader is first removed from the extrusion die. As a consequence, the segments tilt in the direction of the central axis of the overall arrangement and thus come out of engagement with the ball raceways. In a second step, the segments can then also be removed out of the finished workpiece.

Another method of manufacturing outer parts of constant velocity joints is known from German patent DE 196 37 839, which is however restricted to the manufacture of so-called Rzeppa constant velocity joints. In contrast to the cross groove joint outer parts, with this type of joint the ball raceways run in axial direction. Here, an axial separation of outer and inner parts of the constant velocity joint is prevented in that either the ball raceways and/or the cage guide surface have an axial undercut. With this known method the preliminary workpiece is likewise subjected to cold forming in a working operation. This is effected by means of a wobble extrusion die which is segment-wise differently convexly curved, which is first introduced into the hollow chamber of the preliminary workpiece mounted and fixed in an outer die. Due to the different curvatures of the segments, the wobble extrusion die has rib-like contours on its outer surface which are employed for working the ball raceways.

The wobble extrusion die is then set into a wobble motion whereby it is rolled over the surfaces of the preliminary workpiece which are to be formed, in a plurality of circular orbits. The wobble point of this movement is thereby just below the underside of the preliminary workpiece. During the wobble extrusion in each case only a small region of the ball raceways to be shaped is shaped. When the desired shapings are attained with the preliminary workpiece, the wobble procedure is ended and the wobble extrusion die is again removed. Advantageous with this known method is that a one-piece wobble die can be employed which can be manufactured more economically than a multi-piece segment die and which ensures a high precision in the manufacture of joint outer parts.

The object of the invention is to employ the wobble procedure with a one-piece wobble extrusion die, known for the manufacture of Rzeppa constant velocity joints, also for the manufacture of cross groove constant velocity joints.

The wobble extrusion die in accordance with the invention has—in a projection directed perpendicular to its axis—straight line projection edges and is particularly simply and economically manufacturable.

Figure 2A:
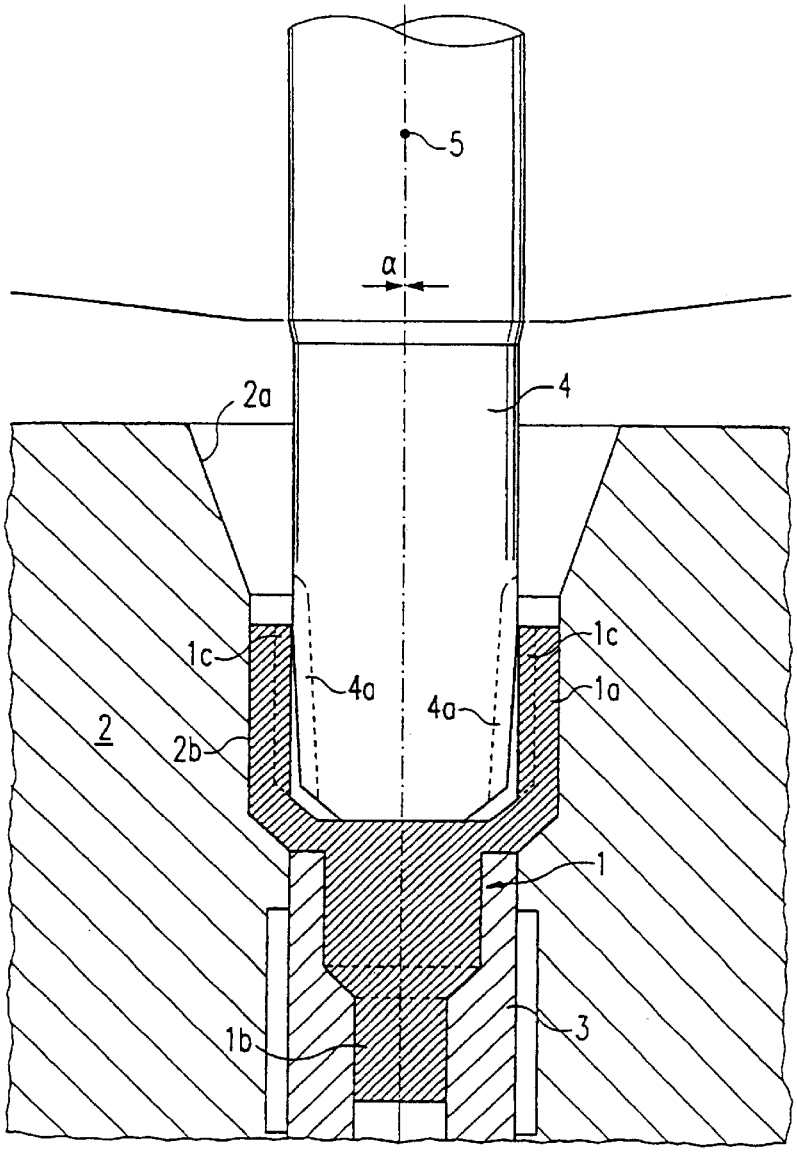
Figure 2B:
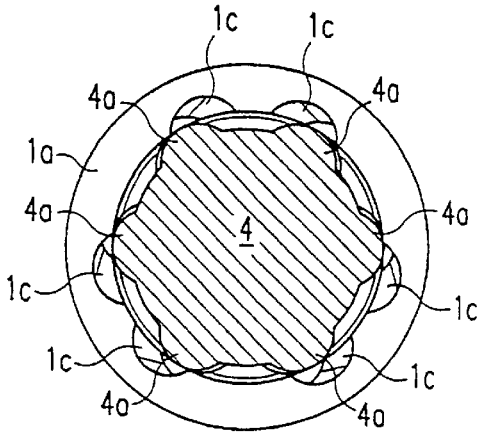
Figure 3A:
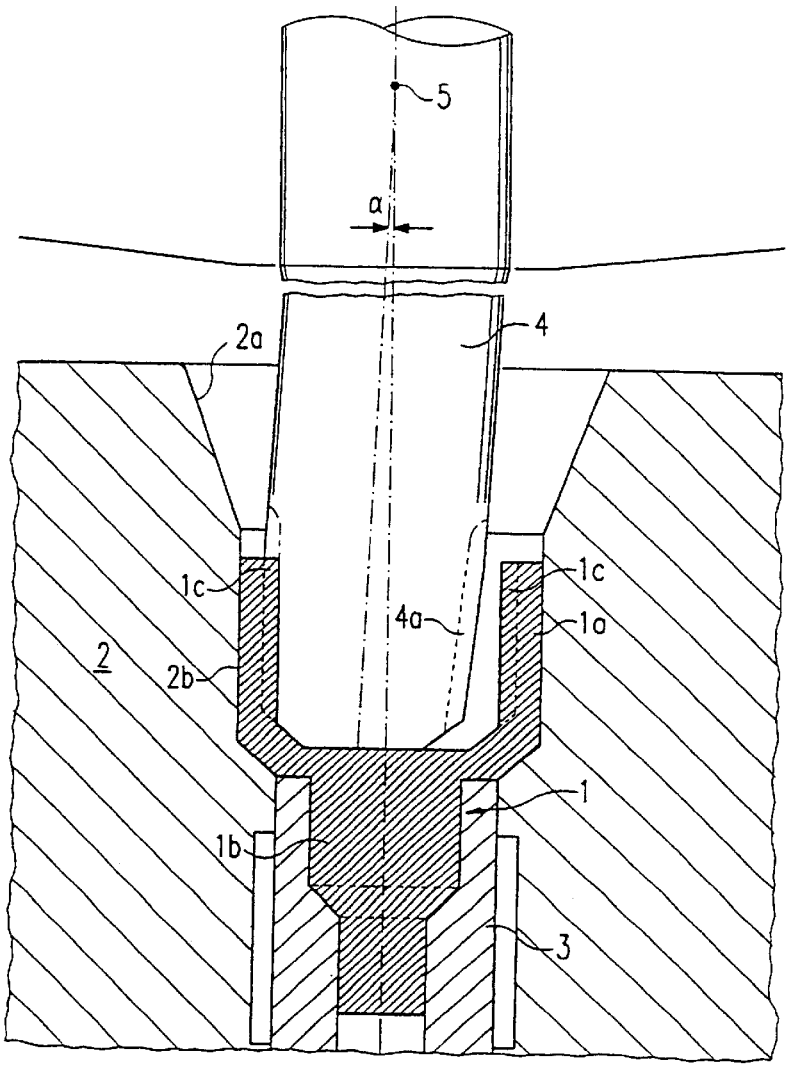
Figure 3B:
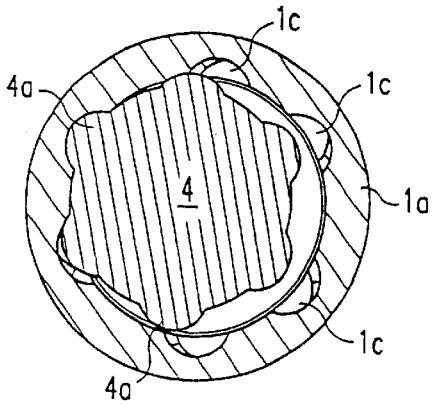
Figure 4:
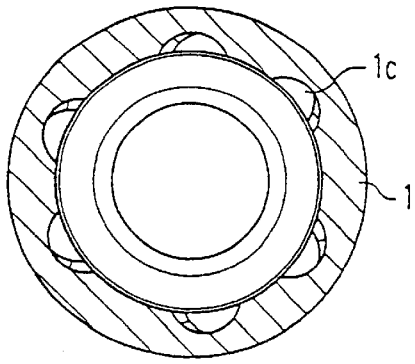

The invention will be explained in more detail below with reference to the Figures of the accompanying drawings. There is shown:

FIG. 1 the arrangement of the preliminary workpiece, the outer die and the wobble extrusion die at the beginning of a method for manufacture of the outer part of a cross groove joint;

FIG. 2*a* the drawing of the preliminary workpiece into the outer die;

FIG. 2*b* in section, the arrangement of the wobble extrusion die in the preliminary workpiece during the drawing;

FIG. 3*a* the re-shaping of the preliminary workpiece by means of the wobble extrusion die;

FIG. 3*b* in section, the arrangement of the wobble extrusion die in the preliminary workpiece during the wobble extrusion;

FIG. 4 a completed cross groove joint outer part in a view from above.

An exemplary embodiment of the invention will first explained in more detail with reference to FIGS. 1 to 3*b*.

The preliminary workpiece 1, the upper part 1*a* of which initially has the shape of a goblet diverging towards the open end is, in a first step—which is illustrated in FIG. 1—arranged in a downwardly narrowing, funnel-shaped opening 2*a* of the outer die 2 of a wobble press, centrally of the machine axis. The ball races 1*c* are already pre-formed on the inner wall of the upper part 1*a*. In the lower region, the preliminary workpiece 1 has an integral pin 1*b* running in the axis direction. For stabilization, this pin 1*b* is surrounded by a shell 3 which is displaceable in the axial direction, on the upper edge of which shell the goblet-shaped upper part 1*a* of the preliminary workpiece 1 also bears. In order to avoid a rotation of the preliminary workpiece 1 during the following wobble process, the pin 1*b* may have at its surface a non-illustrated toothing, which engages into a corresponding toothing of the shell 3. It would however also be conceivable that the pin 1*b* has, seen in cross section, a non-round shape.

Then, a wobble extrusion die 4 is placed on to the floor of the upper part 1*a* centrally to the machine axis. This wobble extrusion die 4 is formed in its lower region with a truncated cone shape, there being arranged on its outer surface integral line-like elevations 4*a* corresponding to the ball raceways 1*c*, which elevations are inclined in the longitudinal direction with respect to the truncated cone axis of the wobble extrusion die 4. The funnel-shaped section 2*a* of the outer die 2 is continued with a cylinder-shaped second section 2*b*, the shape of which corresponds to the outer contour of the finished upper part 1*a* of the joint outer part.

By means of the exercise of an axial pressure via the wobble extrusion die 4, the preliminary workpiece 1 is pressed downwardly, whereby the goblet-shaped upper part 1*a* of the funnel-shaped section 2*a* is drawn into the cylinder-shaped section 2*b* of the outer die 2 and the pin 1*b*, and the shell 3 surrounding it, are displaced further downwardly. Thereby, the side walls of the upper part 1*a* are so directed that at the end of the drawing they run parallel to the machine axis and the inner wall of the hollow chamber of the upper part 1*a* is thus cylindrical, as can be understood from FIG. 2*a*. The shape of the wobble extrusion die 4, including its elevations 4*a*, is thereby so selected that it does not touch the side walls of the upper part 1*a*. Its arrangement in the preliminary workpiece 1 during the drawing is illustrated in section in FIG. 2*b*.

Then, the wobble extrusion die 4 and the preliminary workpiece 1 are set into a wobbling circular motion relative to one another, whereby the wobble angle α, that is the angle between the machine axis and the axis of the wobble extrusion die 4 is selectable. If the wobble angle α is greater than 0°, the two axes intersect at the wobble point 5 which in the illustrated example is located above the outer die 2. The wobble extrusion die 4 thereby rolls with its outer contour on the cylindrical inner wall of the hollow chamber. It is so constituted that the outer side, working the upper part 1*a* of the preliminary workpiece 1 and also the corresponding elevation 4*a* run parallel to the machine axis and to the already upstanding side walls of the upper part 1*a*. This is attained by means of the selected truncated cone shape, taking into consideration the parameters of the wobble movement. The relative arrangement between the side walls of the upper part 1*a*, the wobble extrusion die 4 and the elevations 4*a* is illustrated in a side view in FIG. 3*a* and in section in FIG. 3*b*.

With the above described configuration it is attained that the wobble extrusion die 4 during the wobbling works the preliminary workpiece 1 always over the complete height of the side walls of the upper part 1*a*. This permits a working which is both extremely precise and also very effective, so that with this method a contour-near shape can be attained on the inner side of the goblet-shaped upper part 1*a* which could not be attained by means of drawing and pressing alone. In particular the need for material removing subsequent working of the permanent workpiece 1 is obviated, whereby the time required for the production and also the manufacturing costs of a joint outer part are significantly reduced.

After completion of the wobble working process, the wobble extrusion die 4 is drawn out of the finished workpiece 1. As also with drawing into the preliminary workpiece 1, the wobble extrusion die 4 is thereby directed parallel to the machine axis, i.e. α is equal to 0°. Correspondingly, in the configuration of the wobble extrusion die 4 it must be taken into consideration that its outer contour, inclusive of the line-like elevations 4*a* located on the outer surface of the truncated cone-shaped section, may not have a greater diameter than the hollow chamber of the finished joint outer part.

Finally, the shell 3 is again pushed upwards so that the finished workpiece 1 can simply be removed or pushed out of the funnel-shaped opening 2*a* of the outer die 2. The outer part of a cross groove joint manufactured in this way is illustrated in FIG. 4 in a view from above.

The shape of the wobble extrusion die proposed here distinguishes itself in particular in that there is attained a contact between the wobble extrusion die and the workpiece which is as great as possible, whereby a very effective working of the workpiece is made possible. Further, a wobble extrusion die of this shape is not only more economical and simpler to manufacture, but also can be manufactured to lesser tolerances than the known segmented or spreader die for the manufacturing method for outer parts of a Rzeppa constant velocity joint.

Attention is also directed to the fact that with the above-described method various types of wobble press can be employed. The most commonly used wobbled presses are classified into a plurality of types in accordance with their die movements.

In the case of the wobble press of type 1, the outer die 2—with the workpiece 1 placed therein—carries out a driven rotation movement around the machine axis. The wobble press die 4 rotates synchronously with the rotational movement of the outer die 2 around the wobble axis inclined by the wobble angle α. A translational movement, which corresponds to a stroke movement during the forming procedure, is likewise introduced by means of the wobble press die 4 hydraulically. This translational movement is carried out in order to hold the wobble press die 4, at each point in time, at a suitable height with respect to the workpiece 1. If the rotational movement of the wobble press die 4 is not driven, e.g. if this die rotates freely around the wobble axis with the workpiece 1, one speaks of wobble press of type 1A. If, on the other hand, the rotational movement of the wobble press die 4 is additionally driven, this is called a wobble press of type 1B.

A wobble press of type 2 has a fixed outer die 2, which can carry out neither translational nor rotational movements. The workpiece 1 is stationary during the whole working procedure. Thereby, however, the wobble press die 4 carries out in total three movements, a rotational movement around the wobble axis, a wobble movement around the machine axis, and a hydraulically driven stroke movement in axial direction.

Type 3 wobble presses, in contrast, represent the most common type of wobble press. Here, the hydraulically driven stroke movement is effected by means of a cylinder in the lower part of the machine. The translational movement is thus carried out by means of the outer die. The wobble movement is introduced by means of the wobble press die 4, the outer die 2 and the workpiece 1 remain stationary with regard to the rotational movement.

In general, with all above-mentioned types, the wobble point 5 may—considered mathematically—be infinitely distant, which leads to a rolling movement (wobble angle α=0°). This rolling movement thus represents an extreme case of a wobble movement.

Independently of the type of wobble press employed for the method in accordance with the invention it is however only of significance that the outer die 2 carries out a wobbling circular movement relative to the wobble press die 4. How the individual movement components of the wobble movement are allocated to the different die parts of the wobble press used in each case is in principle of no significance.

What is claimed is:

1. Method of manufacturing an outer part of a constant velocity joint the outer part having in the finished condition a hollow chamber with a cylinder-shaped inner wall, in which there are provided ball raceways which run obliquely of the cylinder axis and are inclined with respect to one another, having the following method steps:

a) a wobble press die is axially introduced into a goblet-shaped preliminary workpiece for the outer part having a conically developing inner and outer wall and preformed ball raceways in the inner wall, b) the preliminary workpiece is pressed by means of the wobble press die, against a bottom the hollow chamber, through an opening in an outer die, so that a drawing process is carried out in which the preliminary workpiece is so cold formed that the inner wall of the hollow chamber is given a cylindrical shape, characterized by the following method steps:

c) the outer die and the wobble press die, having a truncated cone-shaped outer contour, and having elevations on its outer side corresponding to the ball raceways and having a lesser diameter than the cylindrical hollow chamber of the drawn preliminary workpiece, are, with a wobbling movement of the wobble press die around a wobble point arranged above the floor of the hollow chamber, set into a wobbling circular movement relative to one another such that the elevations of the wobble press die move over the pre-formed ball raceways on the inner wall of the hollow chamber in a pressing and material shaping manner, d) thereafter the wobble press die is axially drawn out of the preliminary workpiece and e) finally, the finished joint outer part is ejected from the outer die.

2. Method according to claim 1, characterized in that, in step c) the outer die, with the workpiece placed therein, carries out a driven rotational movement around a machine axis and the wobble press die rotates therewith around a wobble axis inclined by a wobble angle $\alpha$, synchronously with the rotational movement of the outer die.

3. Method according to claim 2, characterized in that, the rotational movement of the wobble press die is additionally driver.

4. Method according to claim 1, characterized in that, in step c) the outer die is stationary and the wobble press die simultaneously carries out a rotation around the wobble axis, a wobble movement around the machine axis and a stroke movement in axial direction.

5. Method according to claim 1, characterized in that, in step c) the outer die carries out a stroke movement in axial direction and the wobble press die simultaneously carries out a rotation around the wobble axis and a wobble movement around the machine axis.

6. A wobble press die for the manufacture of the outer part for a constant velocity joint, which has a hollow chamber having a cylinder-shaped inner wall in which there are provided ball raceways running obliquely to the cylinder axis and inclined with respect to one another, characterized in that, it has a truncated cone-shaped outer contour with line-like elevations arranged thereon, which elevations run obliquely to the truncated cone axis and are inclined with respect to one another, the truncated cone-shaped outer contour and the line-like elevations arranged thereon are formed with reference to a wobble point which is located spaced from a thickened end of an router contour of the wobble press die on a middle axis thereof.

* * * * *

UNITED STATES PATENT AND TRADEMARK OFFICE

CERTIFICATE OF CORRECTION

PATENT NO. : 6,516,647 B1
DATED : February 11, 2003
INVENTOR(S) : Hirschvogel et al.

It is certified that error appears in the above-identified patent and that said Letters Patent is hereby corrected as shown below:

Title page,
Title, please delete "METHOD OF PRODUCING HOMOKINETIC JOINTS" and insert -- METHOD OF MANUFACTURING CONSTANT VELOCITY JOINTS -- therefore.

Column 4,
Line 58, please delete "Method of manufacturing an outer part" and insert -- Method of manufacturing the outer part -- therefore.
Line 59, please delete "velocity joint the outer part" and insert -- velocity joint, the outer part -- therefore.

Column 5,
Line 2, please delete "wobble press die, against a bottom the hollow chamber," and insert -- wobble press die, sitting on the floor of the hollow chamber, -- therefore.

Column 6,
Line 26, please delete "a thickened end of an router contour" and insert -- a thickened end of the outer contour -- therefore.

Signed and Sealed this

Tenth Day of June, 2003

JAMES E. ROGAN
*Director of the United States Patent and Trademark Office*